US006574925B2

(12) United States Patent
Palagonia et al.

(10) Patent No.: US 6,574,925 B2
(45) Date of Patent: Jun. 10, 2003

(54) EMERGENCY STAIRWELL FOR MULTISTORY BUILDINGS

(75) Inventors: Anthony M. Palagonia, Underhill, VT (US); Stuart K. J. Smyth, South Burlington, VT (US)

(73) Assignee: Maximus Technologies, Essex Junction, VT (US)

( * ) Notice: Subject to any disclaimer, the term of this patent is extended or adjusted under 35 U.S.C. 154(b) by 0 days.

(21) Appl. No.: 10/059,758

(22) Filed: Jan. 29, 2002

(65) Prior Publication Data

US 2003/0074848 A1 Apr. 24, 2003

Related U.S. Application Data

(60) Provisional application No. 60/335,662, filed on Oct. 23, 2001.

(51) Int. Cl.[7] ..... A62B 1/00; G04F 11/00

(52) U.S. Cl. ..... 52/182; 52/185; 52/187; 52/184; 182/48

(58) Field of Search ..... 52/182–191; 182/48

(56) References Cited

U.S. PATENT DOCUMENTS

| | | | | |
|---|---|---|---|---|
| 2,846,731 A | * | 8/1958 | Abler | 52/169.9 |
| 3,980,155 A | * | 9/1976 | Campbell | 182/49 |
| 4,248,020 A | * | 2/1981 | Zielinski et al. | 52/185 |
| 5,377,778 A | * | 1/1995 | Lan | 182/48 |
| 5,539,445 A | | 7/1996 | Rosenberg et al. | |
| 6,000,505 A | | 12/1999 | Allen | |
| 6,279,271 B1 | | 8/2001 | Zittmayr | |

* cited by examiner

*Primary Examiner*—Jeanette Chapman
(74) *Attorney, Agent, or Firm*—Anthony M. Palagonia

(57) ABSTRACT

An emergency stairwell for a building having multiple floors comprising: at least one landing associated with each the floor, each landing increasing in width in at least one horizontal direction from an uppermost landing of an upper floor to a lowermost landing of a lower floor; and at least one set of stairs extending between adjacent pairs of landings.

20 Claims, 6 Drawing Sheets

EMERGENCY STAIRWELL FOR MULTISTORY BUILDINGS

RELATED APPLICATIONS

This application claims priority of Provisional Application S/No. 60/335,662 filed on Oct. 23, 2001.

FIELD OF THE INVENTION

The present invention relates to the field of building design; more specifically, it relates to emergency stairwells for multistory building.

BACKGROUND OF THE INVENTION

Most multistory buildings are provided with emergency stairwells to provide quick evacuation of the building in the event of an emergency such as a fire and as alternative evacuation routes to elevators.

In conventional emergency stairwell design, the widths of the stairwell remains constant from the uppermost floors serviced by the emergency stairwell to the lowermost floors serviced by the emergency stairwell. This design is predicated on the assumption that persons entering the emergency stairwell from lower floors will have reached the lowermost egress from the emergency stairwell before persons entering the emergency stairwell from upper floors reach the lower floors.

One problem with this assumption is that in high buildings, people get tired and their rate of descent slows down. As persons from upper floors overtake these now, slower moving persons, congestion builds up slowing egress still more. A similar slowdown can occur when more vigorous or able persons overtake less vigorous or able persons.

Another problem with conventional emergency stairwells, especially in very high buildings is, other than floor numbering, there is no stimulus that indicates the progress is being made to an eventual egress. Going down floor after floor can become claustrophobic and induce panic in the evacuees.

Providing more emergency stairwells does not address these problems, and building uniformly wider emergency staircases, while addressing some of the problems is wasteful of expensive floor space.

Therefore there is a need for an improved emergency stairwell that reduces or eliminates buildup of congestion on sections of the stairwell servicing lower floors, provides some more than a textual indication that progress toward an egress is being made and does not consume unacceptable amounts of floor space.

SUMMARY OF THE INVENTION

A first aspect of the present invention is an emergency stairwell for a building having multiple floors comprising: at least one landing associated with each the floor, each landing increasing in width in at least one horizontal direction from an uppermost landing of an upper floor to a lowermost landing of a lower floor; and at least one set of stairs extending between adjacent pairs of landings.

A second aspect of the present invention is an emergency stairwell for a building having multiple floors comprising: a plurality of stairwell sections, each section comprising: a set of landings, one landing of each set of landings associated with one the floor, and at least one set of stairs extending between adjacent pairs of landings, all landings within a stairwell section having the same width in at least one horizontal direction; and each stairwell section and associated landings within that stairwell section increasing in width in at least one horizontal direction from an uppermost stairwell section associated with a group of adjacent upper floors to a lowermost stairwell section associated with a group of adjacent lower floors.

BRIEF DESCRIPTION OF DRAWINGS

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE INVENTION

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore it is intended that the following claims cover all such modifications and changes as fall within the true spirit and scope of the invention.

Figure 1:
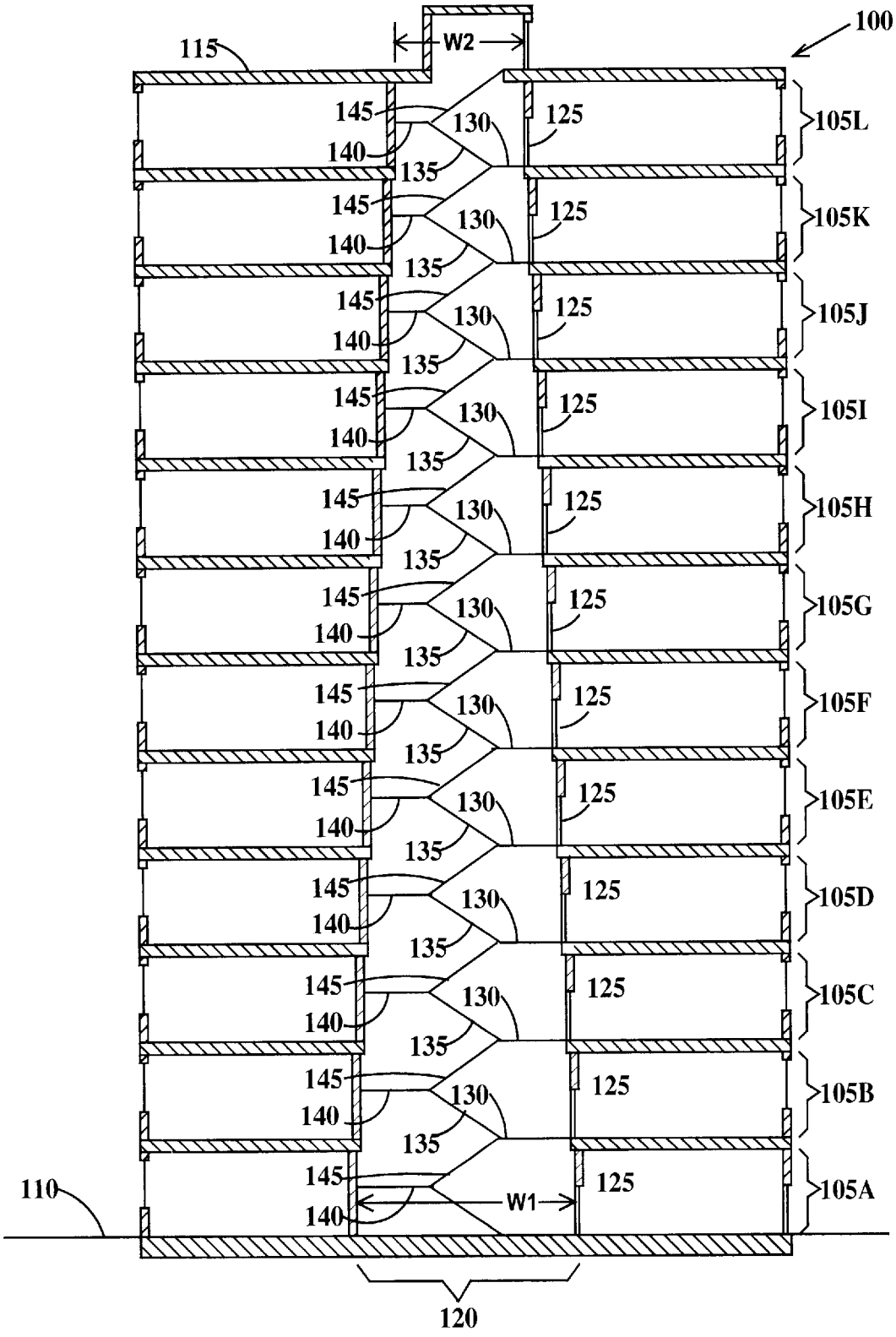
FIG. 1 is cross-sectional view of multistory building having an emergency stairwell according to a first embodiment of the present invention.

FIG. 1 is cross-sectional view of multistory building having an emergency stairwell according to a first embodiment of the present invention. In FIG. 1, a multistory building 100 includes a multiplicity of floors 105A through 105L, floor 105A being the lowest floor, closet to a ground level 110, and floor 105L being the highest floor, immediately under a roof 115. Building 100 also includes an emergency stairwell 120. One or more fire doors 125 on each floor 105 of building 100 provide access to the emergency stairwell.

In one example, fire doors 125 provide access to upper landings 130. Upper stair sets 135 connect upper landings 130 to lower landings 140. Lower landings 140 are connected to the upper landings 130 of the immediately lower floor 105 by lower stair sets 145.

Emergency stairwell 120 has two widths, a first width within the plane of the paper and a second width perpendicular to the plane of the paper. Only the first width is illustrated in FIG. 1. Emergency stairwell 120 has a first width "W1" at the lowest floor in the present example, floor 105A) and a first width "W2" at the highest floor (in the present example, floor 105L.) "W1" is greater than "W2." The first (and second) width of emergency stairwell 10 increases by a fixed amount from floor to floor such that the lower of any two adjacent floors is wider than the upper floor. Upper and lower landings 130 and 140 get wider in both first and second widths, while upper and lower stair sets 135 and 145 only get wider only in the second width, progressively from upper to lower floors. The number of steps (and hence the length) in upper and lower stair sets 135 and 145 remains constant from floor to floor as long as the height of each floor is the same. Or more precisely, the ratio of the total horizontal run to total vertical drop of stair sets 135 and 145 remains constant from floor to floor as long as the height of each floor is the same.

The progressively wider width(s) of emergency stairwell 120 from the upper floors to the lower floors of building 100 works to prevent backup of evacuees in the stairwell on upper floors due to congestion on the stairwell on lower floors by providing increasing area and hence carrying capacity of the stairwell. Further, the progressively wider width(s) of emergency stairwell 120 from the upper floors to the lower floors of building 100 provides visual stimulus that indicates that progress is being made to an eventual egress.

Figure 2:
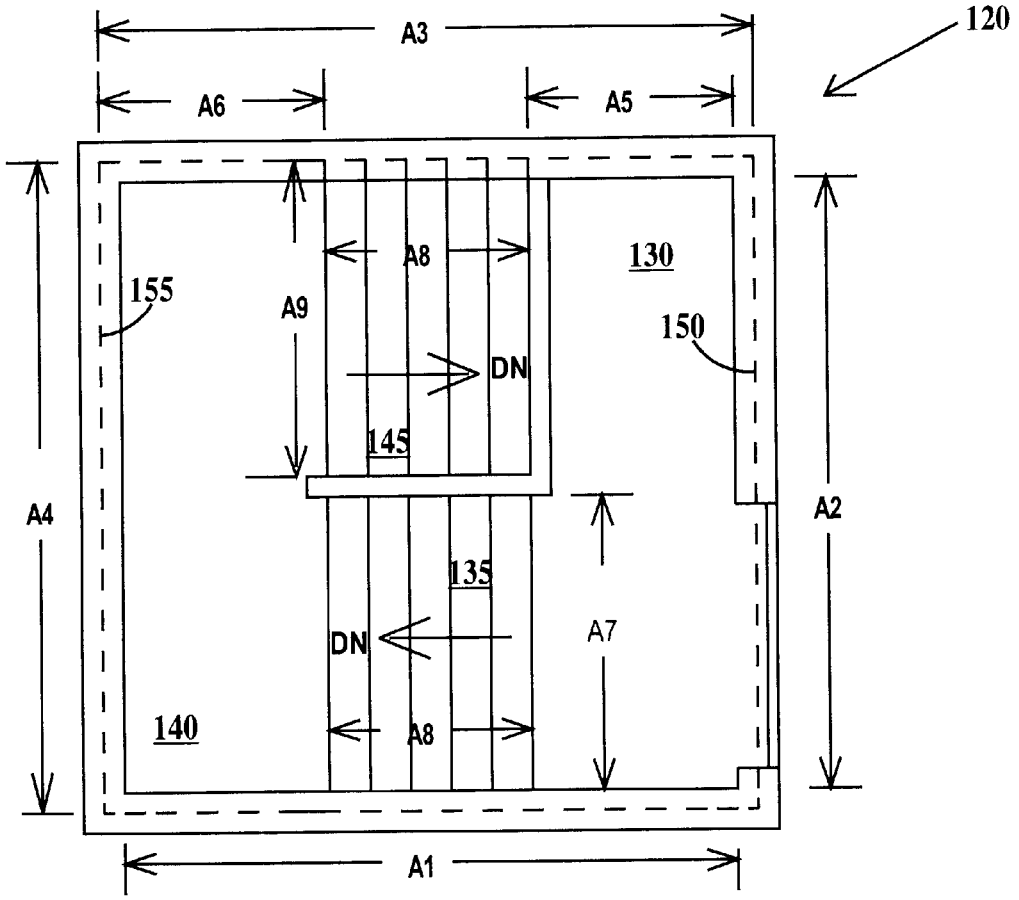
FIG. 2 is top view of a section of the emergency stairwell of FIG. 1.

FIG. 2 is top view of a section of the emergency stairwell of FIG. 1. In FIG. 2, emergency stairwell 120, has a first width "A1" and a second width "A2" in a portion 150 of the emergency stairwell corresponding to an upper floor (for example floor 105L of FIG. 1) and a first width "A3" and second width "A4" in a portion 155 of the emergency stairwell corresponding to a lower floor (for example, floor 105K of FIG. 1.) In one example "A1"="A2,""A3"="A4" and "A1">"A3" by an amount Δ. Upper landing 130 has a first width "A5" and a second width "A2." Lower landing 140 has a first width "A6" and a second width "A4." "A6" is greater than "A5" by amount Δ. Upper stair set 135 has width "A7" and a length "A8." Lower stair set 145 has width "A9" and a length "A8." In one example, "A9"="A7"+Δ/2. Hence, stairwell 120 increases in first and second widths by an amount Δ from the portion of the stairwell immediately above.

Figure 3:
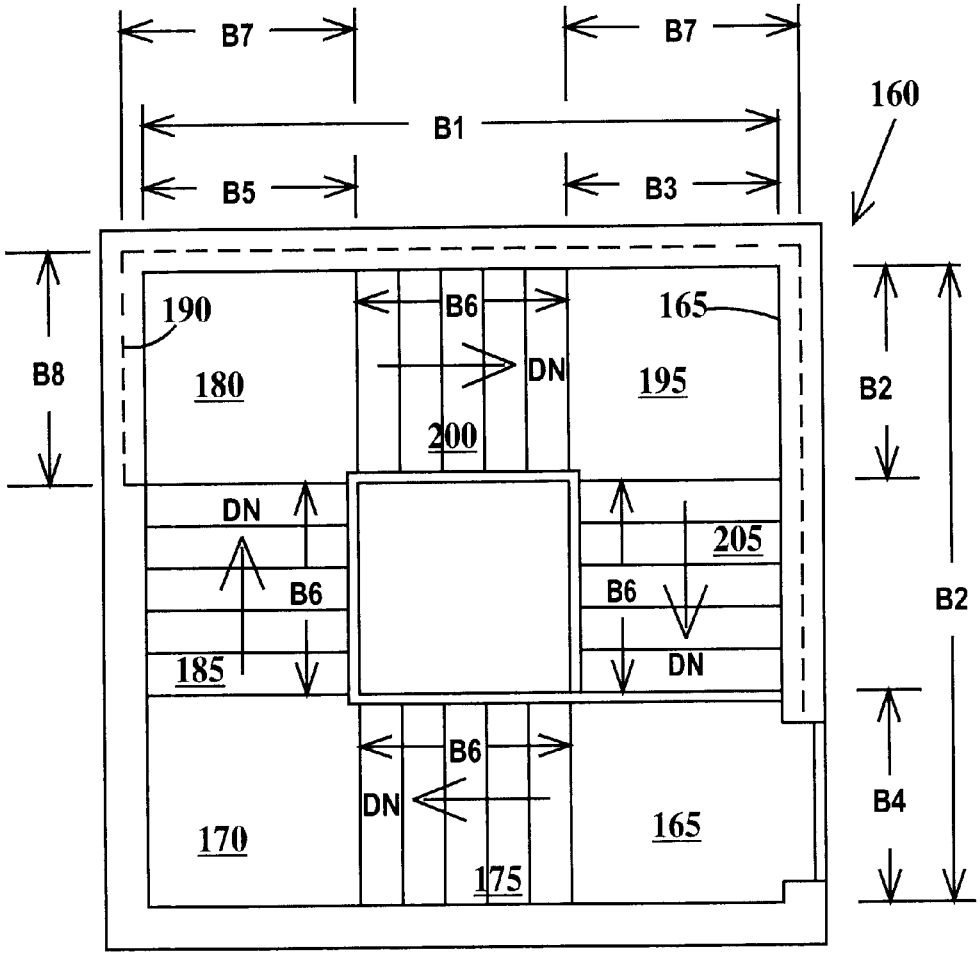
FIG. 3 a top view of a section of an alternative emergency stairwell according to the present invention.

FIG. 3 is a top view of a section of an alternative emergency stairwell according to the present invention. One difference between the emergency stairwell of FIG. 2 and that illustrated in FIG. 3 is the number of landings. In FIG.3, an emergency stairwell 160, has a first width "B1" and a second width "B2" in a portion 165 of the emergency stairwell corresponding to an upper: floor (for example floor 105L of FIG. 1.) An upper landing 165 has a first width "B3" and a second width "B4." A next lower, first intermediate landing 170 has a first width "B5" and a second width "B4." First intermediate landing 170 is connected to upper landing 165 by first stair set 175. First stair set 175 has a first width "B6" and a second width "B4." First intermediate landing 170 is also connected to a second intermediate landing 180 by a second stair set 185. Second stair set 185 has a first width "B5" and a second width "B6." Second intermediate landing 180 has a first width "B7" and a second width "B8." Second intermediate landing 180 resides in a portion 190 of emergency stairwell 160 corresponding to the transition from an upper floor (for example 105L of FIG. 1) and a lower floor (for example, floor 105K of FIG. 1.) Second intermediate landing 180 is connected to a third intermediate landing 195 by a third stair set 200. Third stair set 200 has a first width "B6" and a second width "B8." Third intermediate landing 195 has a first width "B7" and a second width "B8." Third intermediate landing 195 is connected to a lower floor landing (not shown) by a fourth stair set 205. Fourth stair set 205 has a first width "B7" and a second width "B6."

In one example "B1"="B2, "B3"="B4"="B5"="B6," "B7"="B8," ="B7"="B5"+Δ/2 and "B8"="B4"=Δ/2. Δ is the incremental increase in size of emergency stairwell 160 from floor to floor progressing from upper to lower floors.

Figure 4A:
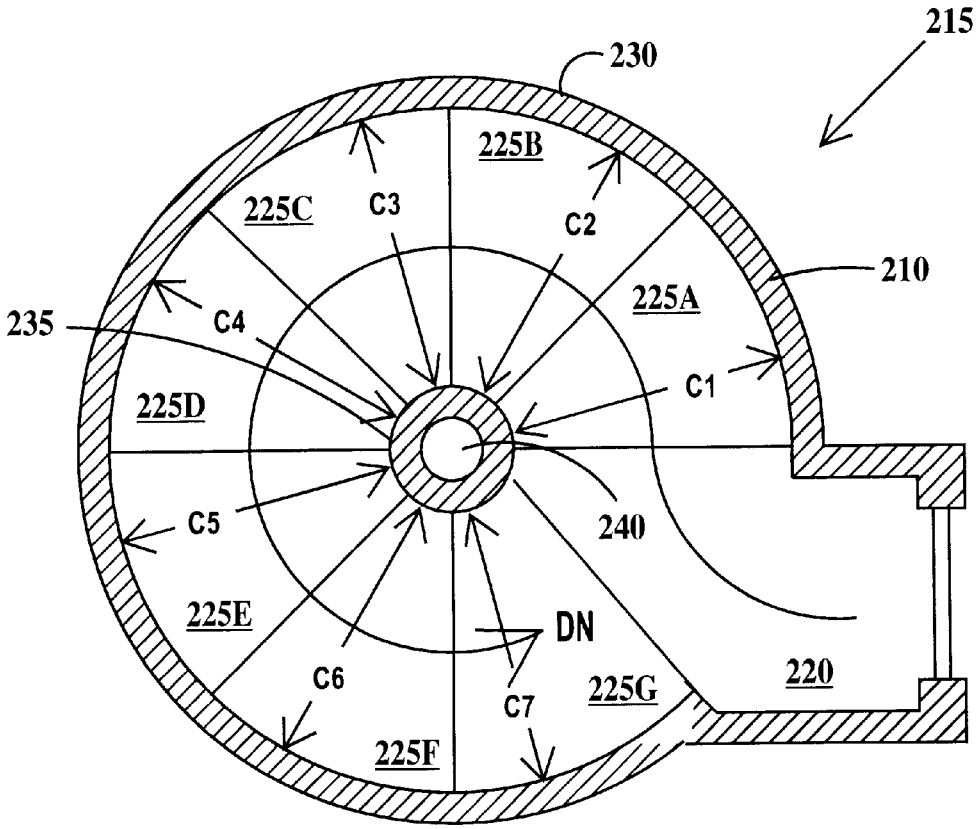
FIG. 4A is a top view of a section of an emergency stairwell according to a second embodiment of the present invention.

FIG. 4A is a top view of a section of an emergency stairwell according to a second embodiment of the present invention. In FIG. 4A, a portion 210 of an emergency stairwell 215 includes a floor landing 220 and a multiplicity of steps 225A through 225G between a cone shaped outer wall 230 and a cylindrical inner wall 235. Inner wall 235 may include a void 240 as illustrated or may be solid. Each step 225A through 225G has a width "C1" through "C7" respectively. Since outer wall 230 is cone shaped each step is wider than the immediately upper step by an amount Δ' but narrower than the immediately lower step by the same amount Δ' . This is more clearly illustrated in FIG. 4B. Therefore, "C2"="C1"+Δ',"C3"="C2"+Δ',"C4"="C3"+Δ', "C6"="C5"+Δ' and "C7"="C6"+Δ'.

Figure 4B:
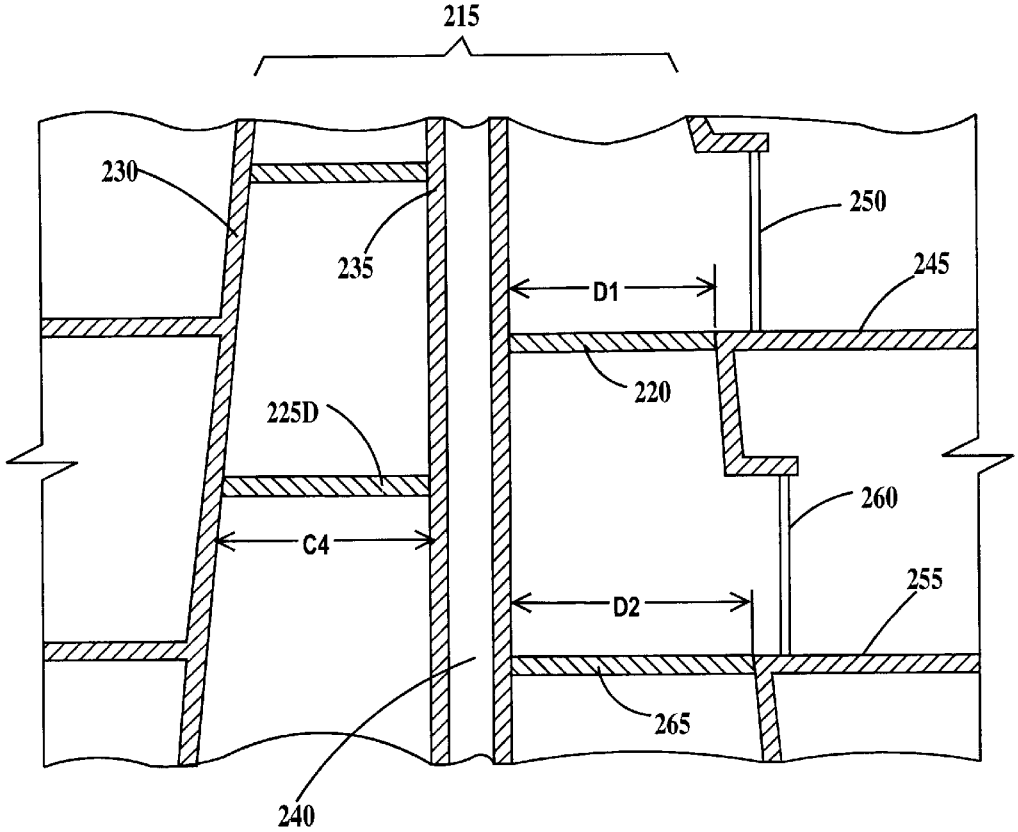
FIG. 4B is a side view of a portion of the emergency stairwell according the second embodiment of the present invention.

FIG. 4B is a side view of a portion of the emergency stairwell according the second embodiment of the present invention. In FIG. 4B, emergency stairwell 215 is shown passing through an upper floor 245 and a lower floor 255. Access to stairwell 215 from upper floor 245 is through fire door 250 onto landing 220. Access to stairwell 215 from lower floor 255 is through fire door 260 onto a floor landing 265. Floor landing 220 on floor 245 is "C1" wide, while step 225D is "C4" wide and floor landing 265 is "C8" wide, where "C8"="C7"+Δ'.

Figure 4C:
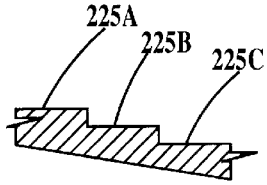
FIGS. 4C and 4D illustrate respectively stepped and ramped options for the second embodiment of the present invention.
Figure 4D:
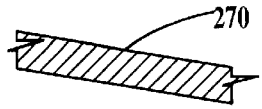

FIGS. 4C and 4D illustrate respectively stepped and ramped options for the second embodiment of the present invention. FIG. 4C is a cross section through a portion of several steps, 225A through 225C of emergency stairwell 215. Optionally, steps may be replaced with a ramp as illustrated in FIG. 4D. FIG. 4D is a cross section through a portion of ramp 270, which replaces steps, 225A through 225C illustrated in FIG. 4C of emergency stairwell 215.

Figure 5:
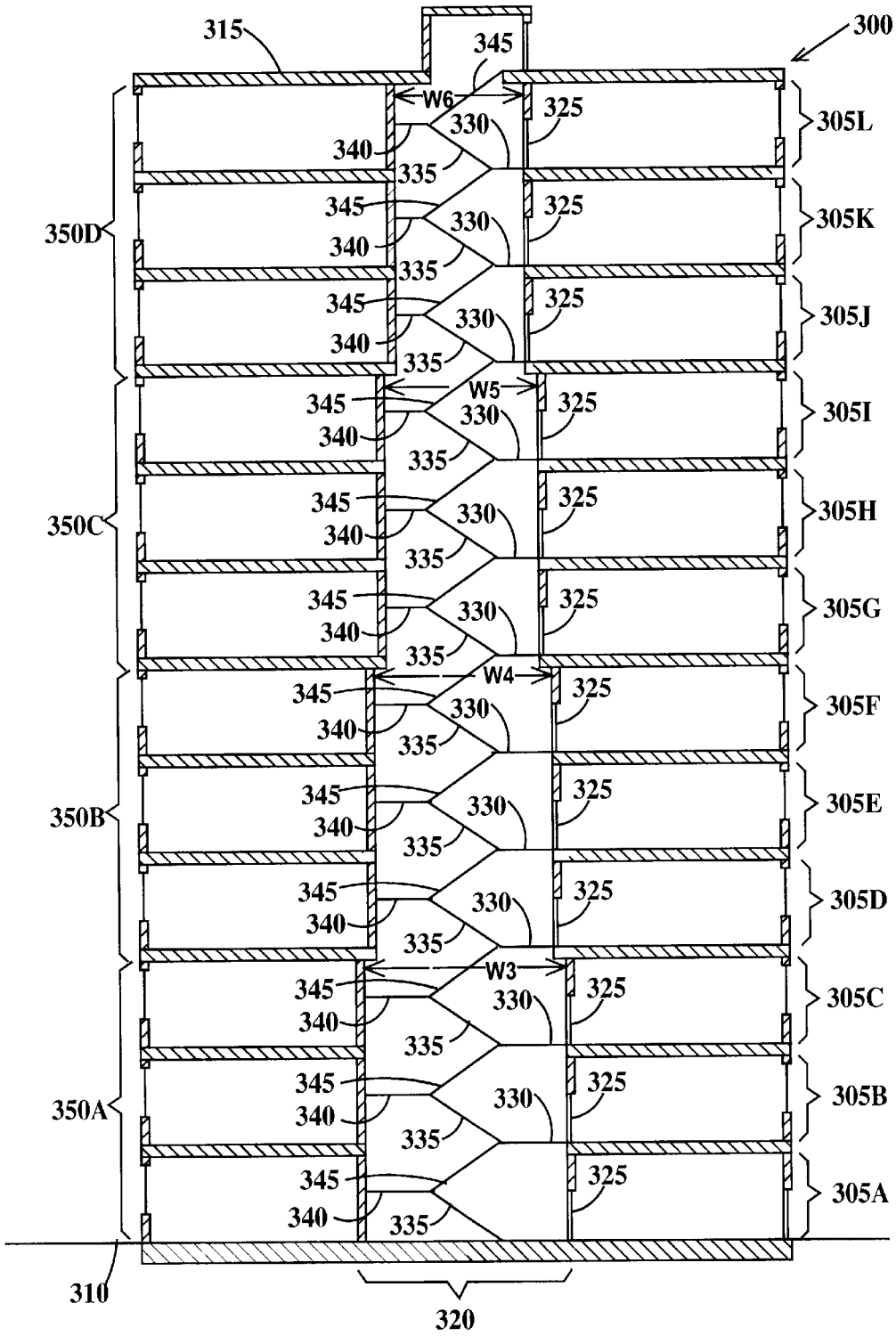
FIG. 5 is cross-sectional view of multistory building having an emergency stairwell according a third embodiment of the present invention.

FIG. 5 is cross-sectional view of multistory building having an emergency stairwell according a third embodiment of the present invention. In FIG. 5, a multistory building 3100 includes a multiplicity of floors 305A through 305L, floor 305A being the lowest floor, closet to a ground level 310, and floor 305L being the highest floor, immediately under a roof 315. Building 300 also includes an emergency stairwell 320. One or more fire doors 325 on each floor 305 of building 300 provide access to the emergency stairwell.

In one example, fire doors 325 provide access to upper landings 330. Upper stair sets 335 connect upper landings 330 to lower landings 340. Lower landings 340 are connected to the upper landings 330 of the immediately lower floor 305 by lower stair sets 345.

Emergency stairwell 320 has two widths, a first width within the plane of the paper and a second width perpendicular to the plane of the paper. Only the first width is illustrated in FIG. 51. Emergency stairwell 320 has a first section 350A having a width "W3" comprised of the three lowest floors (in the present example, floors 305A, 305B and 305C), a second section 350B having a width "W4" comprised of the next three higher (in the present example, floors 305D, 305E and 305F), a third section 350C having a width "W5" comprised of the next three higher (in the present example, floors 305G, 305H and 305I) and a fourth section

350D having a width "W6" comprised of the highest three floors (in the present example, floors 305J, 305K and 305L.) The number of floors 305 within in each section 350 of emergency stairwell 320 may be a number other than three, for example from two half the number of floors in the building or more. The number of floors 305 within each section 350 of emergency stairwell 320 need not be the same. The first (and second) widths of emergency stairwell 320 increases by a fixed amount for example Δ" from section to section such that the lower of any two adjacent sections is wider than the upper section. Thus "W5"="W6"+Δ", "W4"="W5"+Δ" and "W3"="W3"+Δ". Upper and lower landings 330 and 340 get wider in both first and second widths, while upper and lower stair sets 335 and 345 only get wider only in the second width, progressively from upper to lower sections. The number of steps (and hence the length) in upper and lower stair sets 335 and 345 remains constant from floor to floor as long as the height of each floor is the same.

The values for all widths "W1" through "W6", "A1" through "A9", "B1" through "B6", "C1" through "C7" and "D1" through "D2"and all delta's Δ, Δ' and Δ" are primarily functions of the number of occupants of each floor and the number of floors in the building.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. For example, more than one emergency stairwell according to the present invention may be present within the same building. Further, a single emergency stairwell of the present invention need not run through all floors of the building, but only through a contiguous subset of the floors. Still further, the various embodiments of the emergency stairwell of the present invention herein described, may be used in combination with one another within the same building. Finally, one or more emergency stairwells according to the present invention may be used in combination with one or more emergency stairwells of conventional design.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore, it is intended that the following claims cover all such modifications and changes as fall within the true spirit and scope of the invention.

What is claimed is:

1. An emergency stairwell for a building having multiple floors comprising:

at least one landing associated with each said floor, each landing increasing in width in at least one horizontal direction from an uppermost landing of an upper floor to a lowermost landing of a lower floor; and at least one set of stairs extending between adjacent pairs of landings.

2. The emergency stairwell of claim 1, wherein said stairwell has vertical sidewalls.

3. The emergency stairwell of claim 1, wherein said stairwell has sloping sidewalls.

4. The emergency stairwell of claim 1, wherein said stairwell is circular.

5. The emergency stairwell of claim 1, wherein said stairwell has a truncated cone shaped outer wall.

6. The emergency stairwell of claim 1, wherein at least one width of said stairwell in the horizontal direction increases from said uppermost landing to said lowermost landing.

7. The emergency stairwell of claim 1, wherein the width of each set of stairs increases from said upper floors to said lower floors.

8. The emergency stairwell of claim 1, further including one or more sub-landings between adjacent landings, said sub-landings dividing said sets of stairs into subsets of stair of stairs, each subset of stairs extending between a landing and a sub-landing or a sub-landing and another sub-landing.

9. The emergency stairwell of claim 1, wherein the number of steps in any set one of stairs is a function of the distance between adjacent landings connected that one set of stairs.

10. The emergency stairwell of claim 1, wherein some or all of said sets of stairs are replaced by ramps.

11. The emergency stairwell of claim 1, wherein each set of stairs increases in width in at least one horizontal direction an upper floor to an adjacent lower floor.

12. The emergency stairwell of claim 1, wherein said emergency stairwell extends from the roof of the building to the ground floor of the building.

13. An emergency stairwell for a building having multiple floors comprising:

a plurality of stairwell sections, each section comprising:

a set of landings, one landing of each set of landings associated with one said floor, and at least one set of stairs extending between adjacent pairs of landings, all landings within a stairwell section having the same width in at least one horizontal direction; and each stairwell section and associated landings within that stairwell section increasing in width in at least one horizontal direction from an uppermost stairwell section associated with a group of adjacent upper floors to a lowermost stairwell section associated with a group of adjacent lower floors.

14. The emergency stairwell of claim 13, wherein each stairwell section has vertical sidewalls.

15. The emergency stairwell of claim 13, wherein at least one width of each stairwell section in the horizontal direction increases from said uppermost stairwell section to said lowermost stairwell section.

16. The emergency stairwell of claim 13, wherein the width of all sets of stairs in each stairwell section are the same and increase from said uppermost stairwell sections to said lowermost stairwell sections.

17. The emergency stairwell of claim 13, further including one or more sub-landings between adjacent landings within each stairwell section, said sub-landings dividing said sets of stairs into subsets of stair of stairs, each subset of stairs extending between a landing and a sub-landing or a sub-landing and another sub-landing.

18. The emergency stairwell of claim 13, wherein the number of steps in any set one of stairs is a function of the distance between adjacent landings connected by that one set of stairs.

19. The emergency stairwell of claim 13, wherein at least one width in the horizontal direction increases of all sets of stairs in each stairwell section increases from said uppermost stairwell section to said lowermost stairwell section.

20. The emergency stairwell of claim 13, wherein said emergency stairwell extends from the roof of the building to the ground floor of the building.

* * * * *